United States Patent [19]

Oba et al.

[11] 4,184,871

[45] Jan. 22, 1980

[54] PHOTOSENSITIVE COMPOSITION FOR ELECTROPHOTOGRAPHY

[75] Inventors: Hiroshi Oba, Yokohama; Tetsuo Murayama, Machida; Shigenori Otsuka, Yokohama, all of Japan

[73] Assignee: Mitsubishi Chemical Industries Ltd., Tokyo, Japan

[21] Appl. No.: 877,501

[22] Filed: Feb. 13, 1978

Related U.S. Application Data

[63] Continuation of Ser. No. 565,941, Apr. 7, 1975, abandoned.

[51] Int. Cl.[2] ..... G03G 5/09; G03G 5/06

[52] U.S. Cl. ..... 430/90; 430/80; 430/81; 430/83

[58] Field of Search ..... 96/1.5 R, 1.6, 122

[56] References Cited

U.S. PATENT DOCUMENTS

| | | | |
|---|---|---|---|
| 2,271,623 | 2/1942 | Carroll | 96/122 |
| 3,721,552 | 3/1973 | Tellier et al. | 96/1.5 |
| 3,871,883 | 3/1975 | Hashimoto | 96/1.5 |

FOREIGN PATENT DOCUMENTS

| | | | |
|---|---|---|---|
| 944362 | 12/1963 | United Kingdom | 96/1.5 |

OTHER PUBLICATIONS

Hornsby Chemical Reviews, The British Journal of Photography, 5/18/51, p. 247.

*Primary Examiner*—Roland E. Martin, Jr.
*Assistant Examiner*—John L. Goodrow
*Attorney, Agent, or Firm*—Oblon, Fisher, Spivak, McClelland & Maier

[57] ABSTRACT

A photosensitive composition which comprises an electron donative organic photoconductive compound and a sensitizer having the formula wherein A represents an aromatic group or heterocyclic group which can be substituted by an inert group; R represents cyano, nitro, akoxycarbonyl, aryl or carbamoyl group; and n is 0 or 1.

9 Claims, 3 Drawing Figures

PHOTOSENSITIVE COMPOSITION FOR ELECTROPHOTOGRAPHY

This is a continuation of application Ser. No. 565,941, filed Apr. 7, 1975, now abandoned.

BACKGROUND OF THE INVENTION

1. Field of the Invention

The present invention relates to a photosensitive composition for electrophotography. More particularly, it relates to a novel sensitizer which improves the sensitivity of a photosensitive composition when it is added to an organic photoconductive compound.

2. Description of the Prior Art

Heretofore, inorganic compounds such as selenium, zinc oxide, cadmium sulfide or the like, have been used as photosemiconductors for electrophotography. Recently, organic photosemiconductors (organic photoconductive compounds) such as the polyvinyl carbazoles have been considered. However, these organic photosemiconductors usually have low sensitivity. Accordingly, it is necessary to increase their sensitivity by adding a sensitizer in order to make them practical for electrophotographic use. Sensitizers are usually classified into certain groups depending upon the sensitizing mechanism involved. Typical groups are: sensitizers which impart sensitivity because of the presence of absorption bands in the sensitizer, such as dyes; and sensitizers which impart sensitivity by charge transfer interaction with an organic photosemiconductor. The latter is especially superior to the former from the viewpoint of photoresistance. However, practical sensitivity has not been attained by using these conventional sensitizers.

Consequently, it would be most desirable to have a sensitizer, especially from the second class mentioned above, with sufficient sensitivity to enable use as in electrophotography.

SUMMARY OF THE INVENTION

Accordingly, it is one object of the present invention to provide an electrophotography photosensitive composition which has a high degree of sensitivity.

Briefly, this and other objects of this invention, as will hereinafter become more apparent, have been attained by the finding that certain cyanovinyl derivatives impart remarkable sensitizing effect to organic photoconductive compounds. More particularly, the invention provides an electrophotography photosensitive composition which comprises an electron donative organic photoconductive compound and a compound having the formula

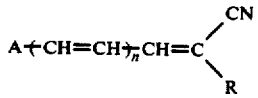

(I)

wherein A represents an aromatic group or heterocyclic group which can be substituted by an inert group; R represents a cyano, nitro, alkoxycarbonyl, aryl, or carbamoyl group; and n is 0 or 1.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DETAILED DESCRIPTION OF THE PREFERRED EMBODIMENTS

Figure 1:
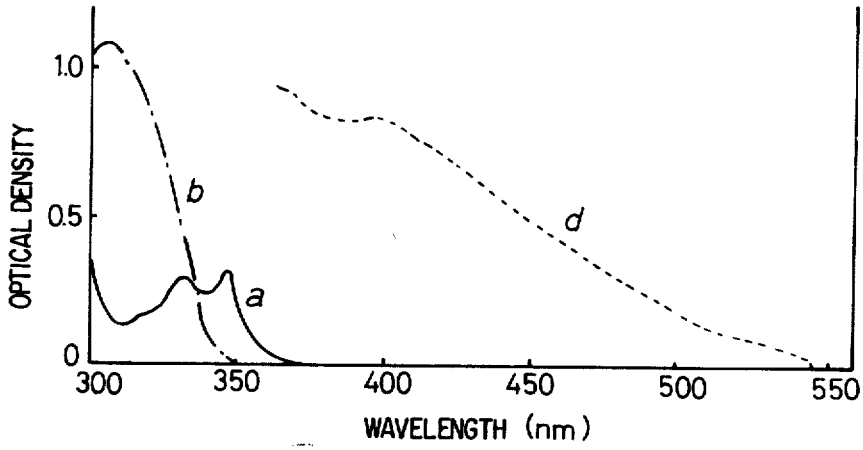
FIG. 1 shows an electronic spectrum of the polymer (a), the sensitizer (b) and the photosensitive composition (d)

The photosensitive composition of the invention comprises a first component which is a sensitizer having the formula (I). In this general formula, A can be an aromatic group, such as phenyl, naphthyl, anthryl and acenapthyl group or the like; or a heterocyclic group, such as furyl and thienyl group or the like. It is especially preferable that A be phenyl, naphthyl, furyl or thienyl group. The aromatic group or the heterocyclic group can contain an inert substituent group, such as chloro, bromo, alkoxy, nitro, cyano and alkoxycarbonyl group; preferably a chloro, nitro, cyano, alkoxy or carbonyl group. R can be a cyano, nitro, alkoxycarbonyl, aryl or carbamoyl group, preferably a cyano group. The aryl or carbamoyl group can have a substituent such as a nitro, a lower alkyl, a phenyl group, or the like. Suitable compounds having the formula (I) include malonic nitriles such as benzal malononitrile, p-chlorobenzal malononitrile, p-bromobenzal malononitrile, p-methylbenzal malononitrile, p-methoxybenzal malononitrile, p-cyanobenzal malononitrile, p-nitrobenzal malononitrile, m-nitrobenzal malononitrile, m-cyanobenzal malononitrile, p-methoxycarbonylbenzal malononitrile, 2-chloro-5-nitrobenzal malononitrile, 2,4-dichlorobenzal malononitrile, 2-thienylmethylene malononitrile, 5-nitro-2-thienylmethylene malononitrile, 1-naphthylmethylene malononitrile, 2-naphthylmethylene malononitrile, 5-acenaphthylmethylene malononitrile, 9-anthracenylmethylene malononitrile, 2-furfurylidene malononitrile, 5-nitro-2-furfurylidene malononitrile, cinnamylidene malononitrile and the like; acrylic acid ester derivatives, such as α-cyano-β-phenyl acrylic acid ethyl ester, α-cyano-β-(p-cyanophenyl)acrylic acid ethyl ester, α-cyano-β-(p-nitrophenyl)acrylic acid ethyl ester, α-cyano-β-(p-chlorophenyl) acrylic acid methyl ester, α-cyano-β-(1-naphthyl)acrylic acid ethyl ester and the like; ethylene derivatives such as 1-cyano-1-nitro-2-phenylethylene, 1-cyano-1,2-bis(p-nitrophenyl-)ethylene, 1-cyano-1-(p-nitrophenyl)-2-(p-cyanophenyl-)ethylene, 1-cyano-1,2-bis(p-cyanophenyl) ethylene and the like; and acrylamide derivatives such as α-cyano-β-(p-nitrophenyl) acrylamide, α-cyano-β-(p-cyanophenyl) acrylamide, α-cyano-β-(2-chloro-5-nitrophenyl)acrylamide, α-cyano-β-naphthyl acrylamide, α-cyano-β-(p-nitrophenyl)-N-phenylacrylamide, α-cyano-β-(p-cyanophenyl)-N-ethylacrylamide and the like. It is preferable to use 1-naphthylmethylene malononitrile, 2-naphthylmethylene malononitrile, 2-furfurylidene malononitrile, cinnamilidene malononitrile, p-methoxycarbonylbenzal malononitrile, and especially, p-nitrobenzal malononitrile, p-cyanobenzal malononitrile, 2-chloro-5-nitrobenzal malononitrile, 1-cyano-1,2-bis-(p-nitrophenyl)ethylene and the like. These compounds can be produced in high yield by a condensation reaction of an aromatic aldehyde with an active methylene compound. A conventional process for producing these compounds is disclosed in Zikken Kagaku Koza Vol. 18 "Reaction of Organic Compound II" (Nippon Kagakukai) (Published by Maruzen).

The photosensitive composition of the invention also comprises a second component which is an electron donative organic photoconductive compound which undergoes a charge transfer interaction with the first component of the sensitizer. (The charge transfer interaction produces a new charge transfer absorption band arising from the charge transfer force between the electron donative compound and the electron acceptive compound.) Suitable electron donative organic photoconductive compounds include aromatic hydrocarbons, such as naphthalene, anthracene, acenaphthene, pyrene, perillene, tetraphene, 2,3-benzochrycene, 6,7-benzopyrene, tetracene, chrycene, fluorene, phenanthrene, triphenylene and the like and heterocyclic compounds such as carbazole, indole, acridine, dibenzothiophene, phenazine, benzofuran, phenothiazine, pyrazoline, benzotriazole, benzimidazole and the like, and derivatives thereof substituted with one or more halogen, alkyl, aryl, alkoxy, aryloxy or amino groups; and polymers and copolymers having a monomer unit derived from such compounds, such as polyvinyl anthracene, polyacenaphthylene, polyvinylpyrene, polyvinylcarbazole, polyvinylacridine, polypyrenylmethyl vinyl ether, polyglycidylcarbazole, polymethylenepyrene, polycarbazolylethyl vinyl ether and derivatives thereof substituted with chloro, bromo, methyl and dimethylamino groups and the like. It is preferable to use a polymer having a carbazole monomer unit, such as polyvinylcarbazole, polyglycidylcarbazole, or a polymer prepared by substituting some of the chlorine atoms of a polyepichlorohydrin. It is especially preferable to use a combination of a first component sensitizer and a second component electron donative organic photoconductive compound which provides a charge transfer interaction, which produces charge transfer absorption bands in the visible range.

The photosensitive composition of the invention is usually prepared by dissolving the first component sensitizer and the second component electron donative organic photoconductive compound in a solvent. The solution is then coated onto a desirable substrate to form a photoconductive layer. The concentration of the organic photoconductive compound in the photosensitive composition is usually 1–80 wt. %, preferably 5–60 wt. %. The quantity of the sensitizer relative to the quantity of organic photoconductive compound is not critical. It is dependent upon the sensitivity, the color depth of photoconductive layer and miscibility, and is usually 0.1–100 mole % of the quantity of the organic photoconductive compound. The solvent may be any of those which dissolve both the sensitizer and the organic photoconductive compound. Suitable solvents include tetrahydrofuran, 1,2-dichloroethane, monochlorobenzene, toluene, dimethylformamide and the like. The quantity of the solvent should be sufficient to dissolve both the first and second components.

Suitable substrates include zinc plate, copper plate, paper, plastic film or sheet. The photosensitive compositions of the invention can contain other additives such as a conventional sensitizer, a binder, plasticizer, a dye, a pigment and the like.

Although the sensitizer and the organic photoconductive compound are colorless or pale yellow, the photoconductive layer prepared by coating the composition usually is colored due to the shifting of charge transfer absorption bands into the visible range, resulting from the charge transfer interaction of the combination of the first and second components. The shifting of charge transfer absorption bands resulting from the mixing substantially corresponds to a shift of photocurrent to the longer wavelength side. This may be seen in a comparison of the electronic spectrum of the photoconductive layer with its photocurrent. Accordingly, it is clear that the improvement in sensitivity caused by the sensitizer of the invention is dependent upon the charge transfer interaction.

The photosensitive composition of the invention has high sensitivity and can be employed in many electrophotography fields such as photocopying, microfilming, photographic paper production, and the like.

Having generally described the invention, a more complete understanding can be obtained by reference to certain specific examples, which are provided herein for purposes of illustration only and are not intended to be limiting unless otherwise specified.

EXAMPLE PREPARATION 1

Preparation of a sensitizer made of 1-cyano-1,2-bis(p-nitrophenyl)ethylene

A 1.5 g sample of p-nitrobenzaldehyde and 1.7 g of p-nitrobenzylcyanide were dissolved in 5 ml of hot ethanol, and 0.05 ml of pyridine was added. The mixture was heated for 10 minutes. After cooling overnight, the precipitated crystals were filtered and recrystallized from a mixture of acetone and ethanol to obtain 1-cyano-1,2-bis(p-nitrophenyl)ethylene having a melting point of 216.5°–217.5° C.

The elementary analysis of the product was as follows:

| | C | H | N |
|---|---|---|---|
| Measured (wt. %) | 60.78 | 3.31 | 14.41 |
| Calculated (wt. %) | 61.02 | 3.07 | 14.23 |

EXAMPLE 1

A 5.0 g sample of polyvinylcarbazole (manufactured by BASF) and 0.25 g of each of various sensitizers were dissolved in 50 ml of 1,2-dichloroethane. Using a Baker applicator, the solution was coated onto a 0.3 mm thick aluminum plate which was treated by sand blasting. This provided a layer having a dry thickness of 15 μm, whereby a photoconductive layer was formed. After drying, the surface of the photoconductive layer was positively charged by a Corona discharge in darkness. The charged photoconductive layer was exposed to radiation from a halogen lamp in order to measure the exposure period required for half decay of the surface potential. The relative sensitivity was calculated assuming that the sensitivity of the polyvinylcarbazole itself was one. The results are given in Table 1.

TABLE 1

| | Sensitizer | Relative sensitivity |
|---|---|---|
| 1 | benzalmalononitrile | 114 |
| 2 | p-nitrobenzalmalononitrile | 308 |
| 3 | m-nitrobenzalmalononitrile | 247 |

TABLE 1-continued

| | Sensitizer | Relative sensitivity |
|---|---|---|
| 4 | p-methoxybenzalmalononitrile | 95 |
| 5 | p-chlorobenzalmalononitrile | 154 |
| 6 | 2,4-dichlorobenzalmalononitrile | 238 |
| 7 | p-cyanobenzalmalononitrile | 370 |
| 8 | 2-chloro-5-nitrobenzalmalononitrile | 667 |
| 9 | 9-anthracenylmethylenemalononitrile | 105 |
| 10 | 2-naphthylmethylenemalononitrile | 278 |
| 11 | α-cyano-β-(p-cyanophenyl)acrylic ethyl ether | 154 |
| 12 | 1-cyano-1,2-bis(p-nitrophenyl)ethylene | 351 |
| 13 | cinnamylidenemalononitrile | 267 |
| 14 | 2-furfurylidenemalononitrile | 118 |
| 15 | α-cyano-β-(p-nitrophenyl)acrylamide | 154 |

A 50 wt. parts sample of the sensitizer, benzalmalononitrile or 2-chloro-5-nitrobenzalmalonitrile, and 100 wt. parts of a binder polymer, cellulose acetate (manufactured by Junsei Kagaku Co.), were dissolved in tetrahydrofuran. In accordance with the above process, the solution was coated to form a layer, the layer was charged and then it was exposed to the halogen radiation. However, no attenuation of the surface potential was found. Thus, the sensitivity of the sensitizer itself to the halogen lamp was substantially zero.

EXAMPLE 2

A 1.0 g sample of polyvinylcarbazole and 0.05 g of p-nitrobenzalmalononitrile were dissolved in 10 ml of 1,2-dichloroethane. In accordance with Example 1, the solution was coated onto an aluminum plate. After drying, the surface was positively charged by the Corona discharge. The charged layer was exposed for 0.2 second at an intensity of 400 lux from a tungsten-filament lamp and passed through a transparent positive original. The exposed layer was developed with a commercial developer to obtain a clear image which corresponds to the original object.

EXAMPLE 3

A 1.0 g sample of polyvinylcarbazole and 0.2 g of p-cyanobenzalmalonitrile were dissolved in 10 ml of 1,2-dichloroethane. In accordance with the process of Example 1, the solution was coated onto an aluminum plate. After drying, the surface layer was positively charged by the Corona discharge. The charged layer was exposed for 0.4 second at an intensity of 400 lux from a tungsten-filament lamp, passed through a transparent positive original, and the exposed layer was developed by a magnetic brush method. A piece of paper was put on the layer and a Corona discharge was applied from the back of the paper in order to transfer the image onto the paper. The image was fixed by heating with an infrared lamp to obtain a sharp image.

EXAMPLE 4

Polyvinylcarbazole was brominated with N-bromosuccinimide to give a 188% brominated polymer. A 10 g sample of the brominated polymer and 0.1 g of cinnamylidene malononitrile were dissolved in 10 ml of monochlorobenzene. In accordance with the process of Example 2, the solution was coated and the layer was charged, exposed and developed to obtain a sharp image.

EXAMPLE 5

Polyacenaphthylene ($\eta$=0.052 (sp/c), c=0.200 g/dl in benzene solution at 30° C.) was produced by polymerizing acenaphthylene in the presence of a boron trifluoride-diethyletherate catalyst in benzene. A 1.0 g sample of polyacenaphthylene, 0.1 g of p-cyanobenzal malononitrile and 0.1 g of a plasticizer of chlorinated paraffin (manufactured by Adeka-Argus Chem. Co.) were dissolved in 10 ml of tetrahydrofuran. In accordance with the process of Example 2, the solution was coated, and the layer was charged and exposed for 1.5 seconds and developed to obtain a sharp image.

EXAMPLE 6

Figure 2:
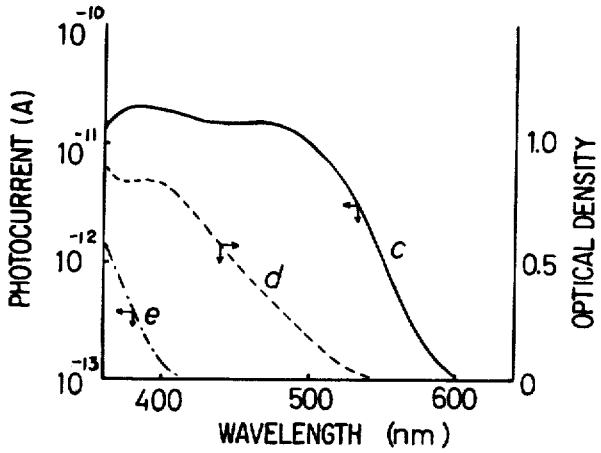
FIG. 2 displays the photocurrent spectrum of the polymer (e) and the photosensitive composition (c) and the electronic spectrum of the polymer (d)

A 1.0 g sample of a polymer prepared by substituting 85% of the chlorine atoms of polyepichlorohydrin with carbazole and 0.2 g of p-cyanobenzal malononitrile were dissolved in 1,2-dichloroethane. The solution was coated by a casting method onto a quartz plate having a transparent electrode consisting of a tin oxide membrane. In accordance with the process of Example 3, the layer was charged, exposed, developed and transferred to obtain a sharp image. An aluminum electrode was formed by vapor deposition onto the layer coated onto the quartz plate. The light emitted from a Xenon lamp was passed through a spectrograph (Narumi R-23 type) and was exposed from the transparent electrode (positive electrode) side of the product in order to enable the measurement of the photocurrent. In FIGS. 1 and 2, the results of the measurements of the photocurrent and the electronic spectrum of the polymer, the sensitizer and the photosensitive composition of the invention are shown.

In FIG. 1, (a) designates the electronic spectrum of the polymer itself; (b) designates the electronic spectrum of the sensitizer itself and (d) designates the electronic spectrum of the photosensitive composition of the invention.

In FIG. 2, (c) designates the photocurrent spectrum of the photosensitive composition of the invention; (d) designates the electronic spectrum thereof; and (e) designates the photocurrent spectrum of the polymer itself.

As is clear from the results, the wavelength dependency of the photocurrent is such that the region of appreciable strength in the photocurrent is extended to the longer wavelength side. This corresponds to the formation of charge transfer absorption bands into the visible range upon the mixing of the sensitizer and the polymer. Accordingly, it is confirmed that the sensitizing effect of the sensitizer is increased by the charger transfer interaction.

EXAMPLE 7

Polyglycidylcarbazole ($\eta$=0.030 (sp/c), c=0.199 g/dl in tetrahydrofuran at 30° C.) was produced by polymerizing N-glycidylcarbazole in toluene in the presence of a boron trifluoride-diethyletherate catalyst. A 1.0 g sample of the polyglycidylcarbazole and 0.05 g of 2-chloro-5-nitrobenzal malononitrile were dissolved in 10 ml of tetrahydrofuran. The solution was coated onto a polyester film having a thickness of 100 μm which was treated to produce electroconductivity. In accordance with the process of Example 2, the layer was charged, exposed and developed. The resulting film was used for slide-projection and produced a sharp image with no fogging.

EXAMPLE 8

A 1.0 g sample of polyvinylcarbazole, 0.1 g of 2-naphthylmethylene malononitrile and 0.005 g of Crystal Violet were dissolved in 1,2-dichloroethane. In accordance with the process of Example 7, the solution was coated and the layer was charged, exposed and developed to obtain a sharp image with no fogging.

EXAMPLE 9

A 0.3 g sample of 2-chloro-5-nitrobenzal-malononitrile; 3.0 g of fluorene and 5.0 g of polyvinylacetate were dissolved in 35 ml of tetrahydrofuran. The solution was coated by a Baker applicator onto an aluminum plate having a thickness of 0.3 mm which was treated by sand blasting, to provide a layer having a dry thickness of 15 μm, whereby a photoconductive layer was formed. A positive charge was placed onto the surface of the photosensitive plate by a Corona discharge in darkness. The charged photosensitive plate was exposed for 25 seconds at a distance of 15 cm to a 15 W fluorescent lamp light source (manufactured by Mitsubishi Denki K.K.) (F L 155 BL-360) radiating through a transparent original. Then, the layer was developed with a liquid developer to obtain a sharp image. As a reference, the process was repeated without fluorene. The exposed time required for forming the image was 1 minute, 20 seconds. The process was also repeated without benzal-malononitrile. No image was obtained even though the film was exposed for 10 minutes.

EXAMPLE 10

Figure 3:
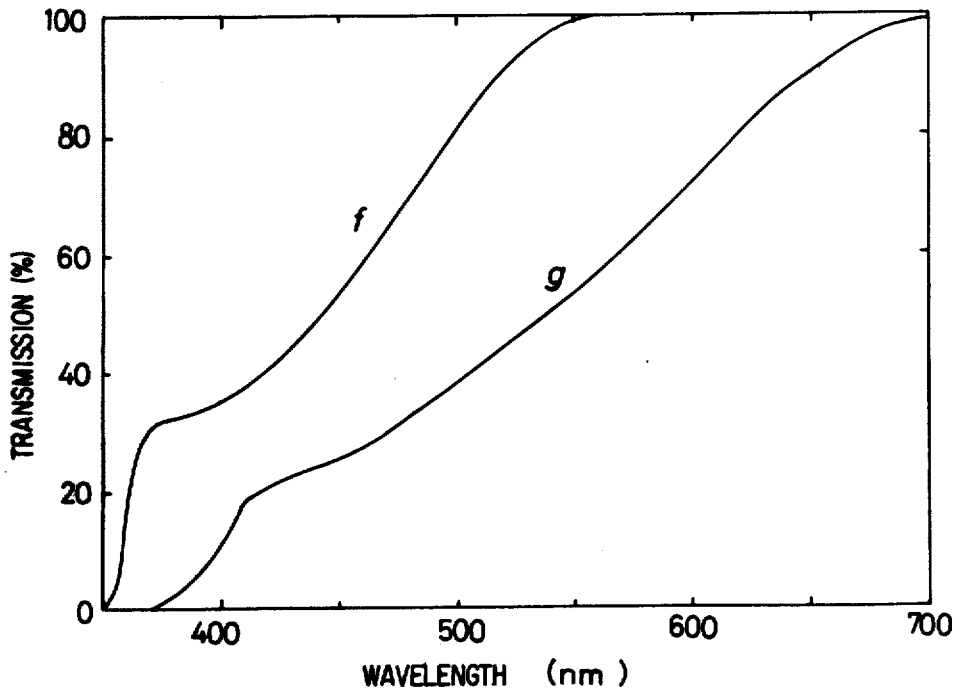
FIG. 3 shows the absorption spectrum of compositions of this invention (f) and (g), as further defined in Example 10.

A solution of 1.0 g of polyvinylcarbazole and 0.2 g of chlorinated paraffin having a chlorine content of 40% in 10 ml of monochlorobenzene was admixed with 0.1 g of p-cyanobenzalmalononitrile. The solution was coated by a Baker applicator onto an electroconductive polyester film (manufactured by Toray Co.) to provide a layer having a dry thickness of 10 μm. Then, it was dried. A reference sample was also prepared in accordance with the above-mentioned process, except using 0.1 g of 2,4,7-trinitrofluorenone, which is a known sensitizer having a very high sensitizing effect, instead of p-cyanobenzalmalononitrile. The film coated with the composition containing p-cyanobenzalmalononitrile was transparent and had a pale yellow color. The film coated with the composition containing 2,4,7-trinitrofluorenone was a transparent film having a chocolate color. The absorption spectrum of each sample is shown in FIG. 3, wherein (f) is the absorption spectrum of the sample using p-cyanobenzalmalononitrile and (g) is the absorption spectrum of the sample using 2,4,7-trinitrofluorenone. The projection density of each sample was measured by a Transmission Densitometer (Quanta Log Model TD-102 manufactured by Macbeth Corp.). The projection density of the sample of the invention was 0.22 and of the reference sample 0.44. The projection density of the polyester film substrate was 0.16. Accordingly, the density of the coated layer itself was 0.06 for the sample of the invention and 0.28 for the reference sample. It is clear that the sample of the invention had excellent transmission as compared to the reference sample. When a sample having higher transmission is developed with a black toner, the contrast of the image is higher, thereby producing an excellent film having high contrast.

Each of the above samples was also exposed to monochromatic light produced by an interference filter (manufactured by Toshiba Co.) in order to compare the spectral sensitivities of the samples. The sensitivity was measured by a radiation level which produced ½ of the initial surface potential after the exposure. The sensitivity of the sample of the invention to the light of 450 nm or 500 nm was 1.5 times that of the sample of the reference. When p-nitrobenzalmalononitrile was used instead of p-cyanobenzalmalononitrile, similar results were produced.

EXAMPLE 11

The polymer of Example 6 was admixed with 5 wt. % of each of the sensitizers shown in Table 2 and were treated in accordance with the process of Example 6. The relative sensitivity was calculated assuming that the sensitivity of polyvinylcarbazole itself was one. The results are shown in Table 2.

TABLE 2

| | Sensitizer | Relative sensitivity |
|---|---|---|
| 1 | benzalmalononitrile | 60 |
| 2 | p-nitrobenzalmalononitrile | 177 |
| 3 | m-nitrobenzalmalononitrile | 81 |
| 4 | p-cyanobenzalmalononitrile | 245 |
| 5 | p-chlorobenzalmalononitrile | 65 |
| 6 | 2,4-dichlorobenzalmalononitrile | 120 |
| 7 | 2-chloro-5-nitrobenzalmalononitrile | 231 |
| 8 | 4-acetoxybenzalmalononitrile | 63 |
| 9 | 2-fluoromalononitrile | 74 |
| 10 | α-cyano-β-(p-cyanophenyl) acrylic acid ethyl ester | 98 |
| 11 | 1-cyano-1,2-bis(p-nitrophenyl) ethylene | 270 |
| 12 | 2-furfurylidenemalononitrile | 44 |
| 13 | cinnamylidenemalononitrile | 165 |
| 14 | α-cyano-β-(p-nitrophenyl) acrylic acid ethyl ester | 107 |
| 15 | α-cyano-β-(m-nitrophenyl) acrylic acid ethyl ester | 36 |
| 16 | 1-naphthylmethylenemalononitrile | 114 |
| 17 | 2-naphthylmethylenemalononitrile | 147 |
| 18 | 1,1-dicyano-4-(p-cyanophenyl)-1,3-butadiene | 143 |
| 19 | 1,1-dicyano-4-(p-chlorophenyl)-1,3-butadiene | 150 |
| 20 | 1,1-dicyano-4-(p-nitrophenyl)-1,3-butadiene | 300 |
| 21 | 1,1-dicyano-4-(m-nitrophenyl)-1,3-butadiene | 157 |

EXAMPLE 12

A 1.0 g sample of the polymer of Example 6 and 0.3 g of 1,1-dicyano-4-(p-cyanophenyl)-1,3-butadiene were dissolved in 10 ml of 1,2-dichloroethane. The solution was coated by a Baker applicator onto aluminum foil having a thickness of 20 μm which was laminated onto a polyester film having a thickness of 100 μm, in order to provide a layer having a dry thickness of 12 μm. After drying, a positive charge was placed onto the surface of the photoconductive layer by a Corona discharge (+6 KV applied voltage) in darkness. The charged photoconductive layer was exposed for 1 second at an intensity of 30 lux from a tungsten filament lamp and passed through a transparent positive original. The exposed layer was developed with a commercial developer to obtain a clear image which corresponded to the original.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A photosensitive composition which consists essentially of an electron donative organic photoconductive compound and a sensitizer having the formula

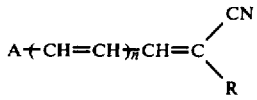

wherein A represents a phenyl, naphthyl, anthryl, acenaphthyl, furyl or thienyl group each of which may be substituted by a group selected from the group consisting of chloro, bromo, alkoxy, nitro, cyano and alkoxycarbonyl; R represents a cyano, nitro, alkoxycarbonyl, aryl or carbamoyl group; and n is 0 or 1; wherein said composition is characterized in that its action spectrum extends to substantially longer wave lengths than the absorption spectrum of either said electron donative photoconductive compound alone or said sensitizer alone.

2. The photosensitive composition of claim 1, wherein said electron donative organic photoconductive compound is a photoconductive compound selected from the group consisting of aromatic hydrocarbons, heterocyclic compounds and polymers and copolymers having a monomer unit derived from either of the same.

3. The photosensitive composition of claim 1, wherein the quantity of said sensitizer is 0.1-100 mole % relative to said organic photoconductive compound.

4. The photosensitive composition of claim 1, wherein said electron donative organic photoconductive compound is polyvinylcarbazole.

5. The photosensitive composition of claim 1, wherein said electron donative organic photoconductive compound is polyglycidylcarbazole.

6. The photosensitive composition of claim 1, wherein said electron donative organic photoconductive compound is a polymer prepared by partially substituting the chlorine atoms of polyepichlorohydrin.

7. The photosensitive composition of claim 1, wherein the concentration of said organic photoconductive compound is 1-80 wt. %.

8. The photosensitive composition of claim 1, wherein said action spectrum extends to 600 nm. in the visible region, and said absorption spectrum of said electron donative organic photoconductive compound and of said sensitizer shows negligible absorption above 450 nm. in the visible region.

9. A method of sensitizing to visible light an electron-donative organic photoconductive compound which alone is substantially insensitive to visible light which consists of adding to said photoconductive compound an amount effective to sensitize said photoconductive compound of a compound having the formula

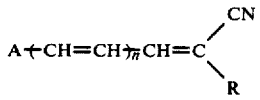

wherein A represents a phenyl, naphthyl, anthryl, acenaphthyl, furyl or thienyl group which may be substituted by a group selected from the group consisting of chloro, bromo, alkoxy, nitro, cyano, and alkoxycarbonyl; R represents a cyano, nitro, alkoxycarbonyl, aryl or carbamoyl group; and n is 0 or 1.

* * * * *